US011359426B2

(12) United States Patent
Davis

(10) Patent No.: US 11,359,426 B2
(45) Date of Patent: Jun. 14, 2022

(54) GATE HINGE PIN ASSEMBLY

(71) Applicant: Bobby G. Davis, Union, KY (US)

(72) Inventor: Bobby G. Davis, Union, KY (US)

( * ) Notice: Subject to any disclaimer, the term of this patent is extended or adjusted under 35 U.S.C. 154(b) by 0 days.

(21) Appl. No.: 16/428,720

(22) Filed: May 31, 2019

(65) Prior Publication Data

US 2020/0011104 A1 Jan. 9, 2020

Related U.S. Application Data

(60) Provisional application No. 62/678,553, filed on May 31, 2018.

(51) Int. Cl.

| | |
|---|---|
| ***E06B 11/04*** | (2006.01) |
| ***E05D 5/12*** | (2006.01) |
| ***E05D 3/02*** | (2006.01) |
| *E05D 5/10* | (2006.01) |

(52) U.S. Cl.

CPC ..... *E05D 5/121* (2013.01); *E05D 3/02* (2013.01); *E06B 11/04* (2013.01); *E05D 2005/102* (2013.01); *E05D 2005/122* (2013.01); *E05Y 2900/40* (2013.01)

(58) Field of Classification Search

CPC ..... E05D 7/08; E05D 2005/102; E05D 2005/122; E05D 3/02; E05D 5/121; E06B 11/04

USPC ..... 16/86.1, 253, 240, 245

See application file for complete search history.

(56) References Cited

U.S. PATENT DOCUMENTS

| | | | | | |
|---|---|---|---|---|---|
| 1,188,302 | A | * | 6/1916 | Mohns | E05D 5/02 16/253 |
| 1,345,559 | A | * | 7/1920 | Slauson | E06B 11/04 49/190 |
| 1,349,797 | A | * | 8/1920 | Williams | E06B 11/04 16/253 |
| 1,467,029 | A | * | 9/1923 | Jamesw | E06B 11/04 16/253 |
| 1,469,425 | A | * | 10/1923 | Mehanna | E06B 11/04 16/252 |
| 1,793,013 | A | | 2/1931 | Robertson | |
| 2,563,960 | A | * | 8/1951 | Reymann | E06B 11/02 16/248 |
| 2,837,760 | A | * | 6/1958 | Ware | E05D 5/02 16/274 |

(Continued)

FOREIGN PATENT DOCUMENTS

| | | | | | |
|---|---|---|---|---|---|
| AU | 8430296 | A | * | 2/1988 | E05D 15/02 |
| FR | 3073241 | A1 | * | 5/2019 | E05D 5/02 |
| GB | 2188091 | A | * | 9/1987 | E05D 3/02 |

*Primary Examiner* — Emily M Morgan

(74) *Attorney, Agent, or Firm* — Carrithers Law Office, PLLC; David W. Carrithers

(57) ABSTRACT

A gate hinge for a preferably wooden post which includes an L-shaped rod threaded on one leg with a metal strap rigidly connected to the threaded leg at about one and one half inches from the elbow of the rod on the threaded leg. The metal strap extends six or so inches form each side of the L-shaped rod with two or more holes near each end of the strap. The L-shaped rod is threaded into the post until the metal strap contacts the post. Then each leg of the metal bracket is bent around the post and screws or lag bolts are threaded through the holes and into the post to help secure the hinge to the post and to provide added support for the gate.

6 Claims, 7 Drawing Sheets

(56) References Cited

U.S. PATENT DOCUMENTS

| | | | | | |
|---|---|---|---|---|---|
| 2,970,799 | A * | 2/1961 | Pinson | E06B 11/04 | 248/230.5 |
| 3,107,390 | A * | 10/1963 | Shelton | E05D 5/02 | 16/224 |
| 3,295,158 | A | 1/1967 | Hotchkiss, Jr. et al. | | |
| 3,304,656 | A | 2/1967 | Dvorak | | |
| 4,079,481 | A | 3/1978 | Cacicedo | | |
| 5,035,084 | A | 7/1991 | Towns | | |
| 5,167,049 | A * | 12/1992 | Gibbs | E05D 5/0215 | 16/253 |
| 6,073,396 | A | 6/2000 | Kietzmann | | |
| 8,413,300 | B1 * | 4/2013 | Luneborg | E05D 5/128 | 16/253 |
| 8,800,110 | B1 * | 8/2014 | Stephenson | E05D 7/0423 | 16/240 |
| 2006/0016046 | A1 * | 1/2006 | Koert | E05D 7/043 | 16/86.1 |
| 2008/0222842 | A1 * | 9/2008 | Faber | E05D 5/02 | 16/86.1 |

* cited by examiner

GATE HINGE PIN ASSEMBLY

CROSS REFERENCES TO RELATED APPLICATIONS

This application claims priority from U.S. Provisional Application Ser. No. 62/678,553 filed on May 31, 2018 and is incorporated by reference herein in its entirety.

TECHNICAL FIELD

The present invention relates to the field of gate hinges, especially those made for use on wooden posts.

BACKGROUND OF THE INVENTION

Gate hinges have been in use for hundreds of years. Gates historically have been made of wooden slats nailed or bolted together and therefore tend to be quite heavy. A wooden gate that is sixteen feet long and which is four and one half feet tall can weigh more than one hundred pounds. Such a gate causes a great deal of strain on a post and on the hinges which must support the weight of the post plus the stresses put on the gate when swinging open and closed.

Typical farm gate hinges and some garden or yard gate hinges include two parts, a looped member which is fastened with the loop near one vertical edge of the gate, and a threaded hinge pin wherein one leg is threaded into a wooden post and wherein the other leg extends either upward or downward and wherein the loop of the loop member is slipped down over the upward or downward extending leg of the threaded hinge pin, as shown in FIG. 6. Such gates are generally fitted with two of these two part hinge, but in the case of a very heavy gate, three or more hinges may be required.

The most stressful position for that portion of gate hinge which is directly connected to the post is that in which the gate is wide open. As shown in FIG. 7, the gate is pulling to the left against the threaded hinge pin 9. Is the gate has two hinges 9, the upper hinge is being pulled to the left, and the lower hinge is being pulled to the right. As time goes on, the hinges 9 will either get bent under the severe load or the holes in the post in which the L-shaped members are threaded will become expanded and the threaded hinge pins will become loose in the holes. In either event, the gate will sag and may even fall to the ground.

DESCRIPTION OF THE RELATED ART

U.S. Pat. No. 8,800,110 for GATE HINGE by Stephenson which issued on Aug. 12, 2014 teaches a hinge including an L-bolt which is threaded and held within a plate by a nut on either side of the plate and wherein the plate has holes through which lag bolts are driven into the wooden post.

U.S. Pat. No. 1,188,302 for GATE HINGE by Mohns which issued on May 20, 1916 teaches an L-bolt cast with a plate with screw holes and a threaded rod which pierces and is threaded into the wooden post, after which a bracket is attached to either side of the plate by hooks and is then bolted around the fence post.

SUMMARY OF THE INVENTION

As shown in the attached figures, the threaded shanke portion of the hinge pin is rotatably inserted into a horizontal hole drilled in the post. A gate usually swings on a pair of spaced apart aligned hinge pins comprising a threaded shank having a distal point and a neck extending to an upturned post comprising a smooth rod or pin post bent at a 90 degree angle with respect to the shaft wherein a horizontal loop or sleeve of a gate post pin receiver is mounted onto a gate and the loop or sleeve extending therefrom mounts onto the pin post and rests on a circumferential lip or shoulder formed above the 90 degree elbow.

Because the weight of the gate pulls on the top hinge and pin, it tends to pull from the post and over time become loose so that the hinge pin rotates and the sleeve supporting the gate slips off of the top pin.

The present invention utilizes a bendable support strap which is welded onto the post pin between the shank threads and the neck extending therefrom. The formable support strap comprises a generally flat bendable support strap of material welded onto the pin at a point where the threads of the shank stop. The strap must be flat in order to screw the hinge pin into the hole in the post until the straps abut the post, whereby the straps are bent around the post and nailed or screwed into the post on either side of the hinge pin providing lateral support to the pin and preventing rotation or twisting of same.

In accordance with the present invention, there is provided a two part gate hinge comprising, consisting of, or consisting essentially of a loop member and an Threaded hinge pin. The L-shaped member includes a long threaded leg about eight to twelve inches long, a 90 degree elbow, a short smooth leg about two and one half inches long, and a long rectangular metal strap about twelve to sixteen inches long, about one and one half to two inches wide and about one eighth to three sixteenths inch thick. The metal strap has a first hole formed therein in a center thereof sized to receive the threaded leg which passes through the first hole and is permanently fixed to the metal strap near the elbow about one and one half inches from the elbow at right angles with the metal strap. The threaded leg has threads formed thereon from the pointed free end to the junction of the threaded leg with the metal strap. The shorter leg of the Threaded hinge pin includes a flat metal washer permanently fixed near the elbow and about two inches from a free end of the shorter leg with a top surface of the washer perpendicular to the shorter leg. The metal strap has at least four holes formed therein, each of the four holes being within about one half inch of each corner. The metal strap is capable of being bent and formed around a partial circumferential surface of a fence post. The loop member comprises a long flat metallic rectangular member about eighteen inches long and about two inches wide, with one end turned back on itself, forming a loop capable of rotatably receiving the short leg or stud of the threaded hinge pin. The loop member has a plurality of holes formed therein for insertion of screws or bolts for fastening the loop member to a vertical edge of a gate.

It is an object of this invention to provide a two part gate hinge including a loop member which is attached to a vertical edge of the gate and an Hinge pin which is threaded into a post with and upward extending leg on which to slip the loop member, and wherein the Hinge pin includes a strap of metal which extend to the left and right of the threaded leg and which includes holes for inserting and threading of screws or lag bolts into the post to brace the Hinge pin from movement to the left or right.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
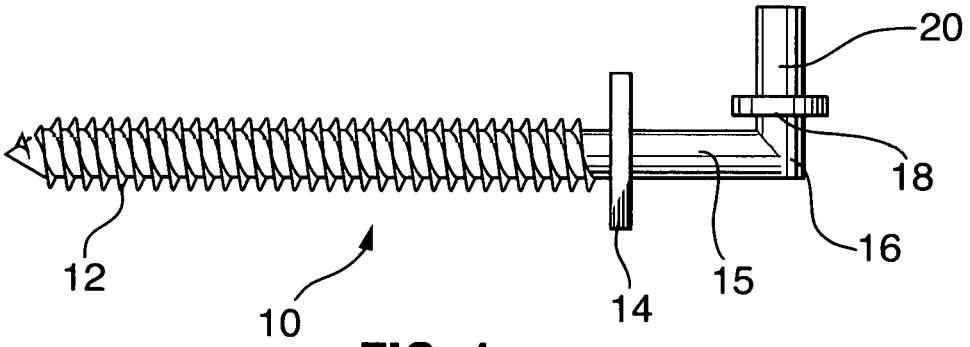
FIG. 1 is a side view of the Hinge pin of the hinge.
Figure 2:
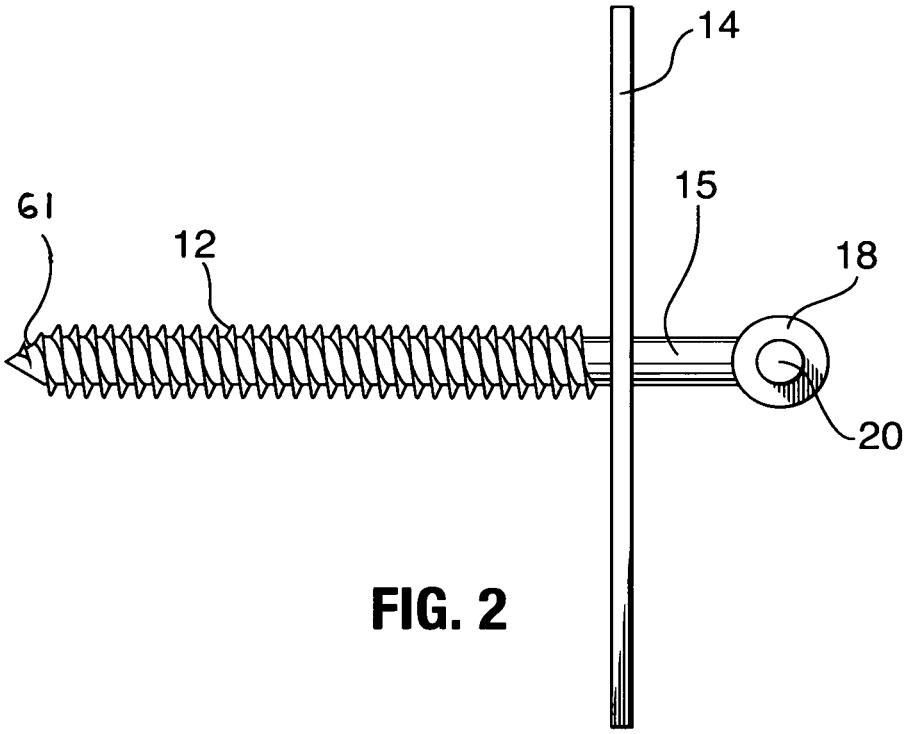
FIG. 2 is a top view of the L-shaped ember of the hinge showing the metal strap extending from each side of the threaded leg.
Figure 3:
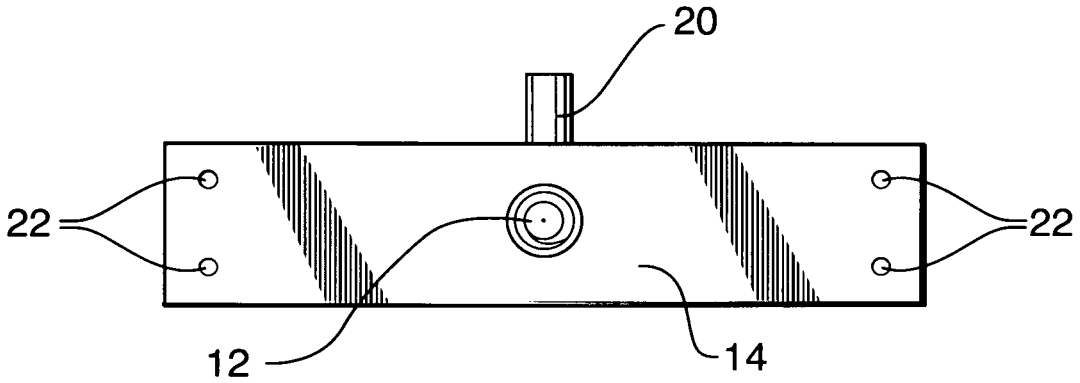
FIG. 3 is an end view of the Hinge pin also showing the flat side of the metal strap with holes for insertion of screws or lag bolts.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As used herein, the term "about" can be reasonably appreciated by a person skilled in the art to denote somewhat above or somewhat below the stated numerical value, to within a range of +10%.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

As shown in the FIGS. 1-16, a gate hinge pin is shown supporting a gate with a gate hinge and pin assembly which includes a loop strap member 30 and an L-shaped threaded hinge pin 10. As shown in the figures, the loop strap member 30 is a long flat metallic rectangular member 34 with one end turned back on itself, forming a loop 32. The loop strap member 30 includes a plurality of spaced apart holes 36 drilled or formed therein for insertion of screws 17 or bolts for fastening the loop strap member to the vertical edge of a gate frame or support member as shown in FIG. 6 for cooperative engagement with a hinge pin extending from a post.

Figure 4:
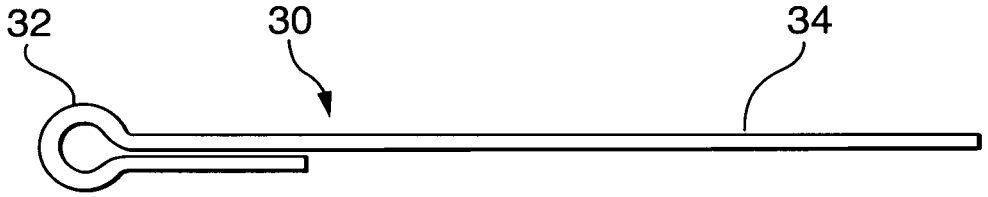
FIG. 4 is a top view of the loop member.
Figure 5:
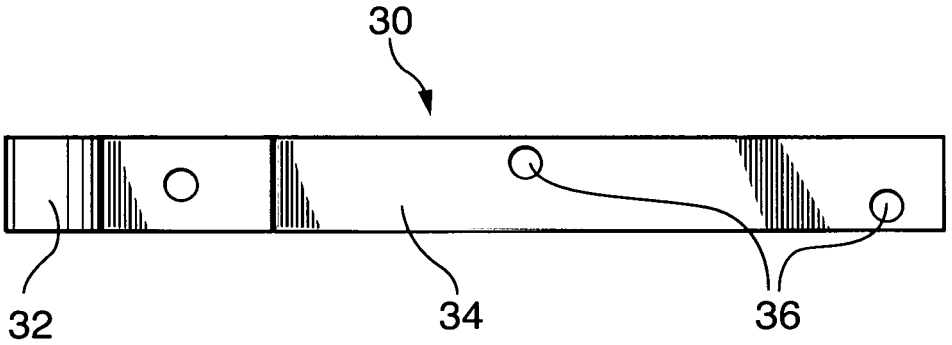
FIG. 5 is a side view of the loop member.
Figure 6:
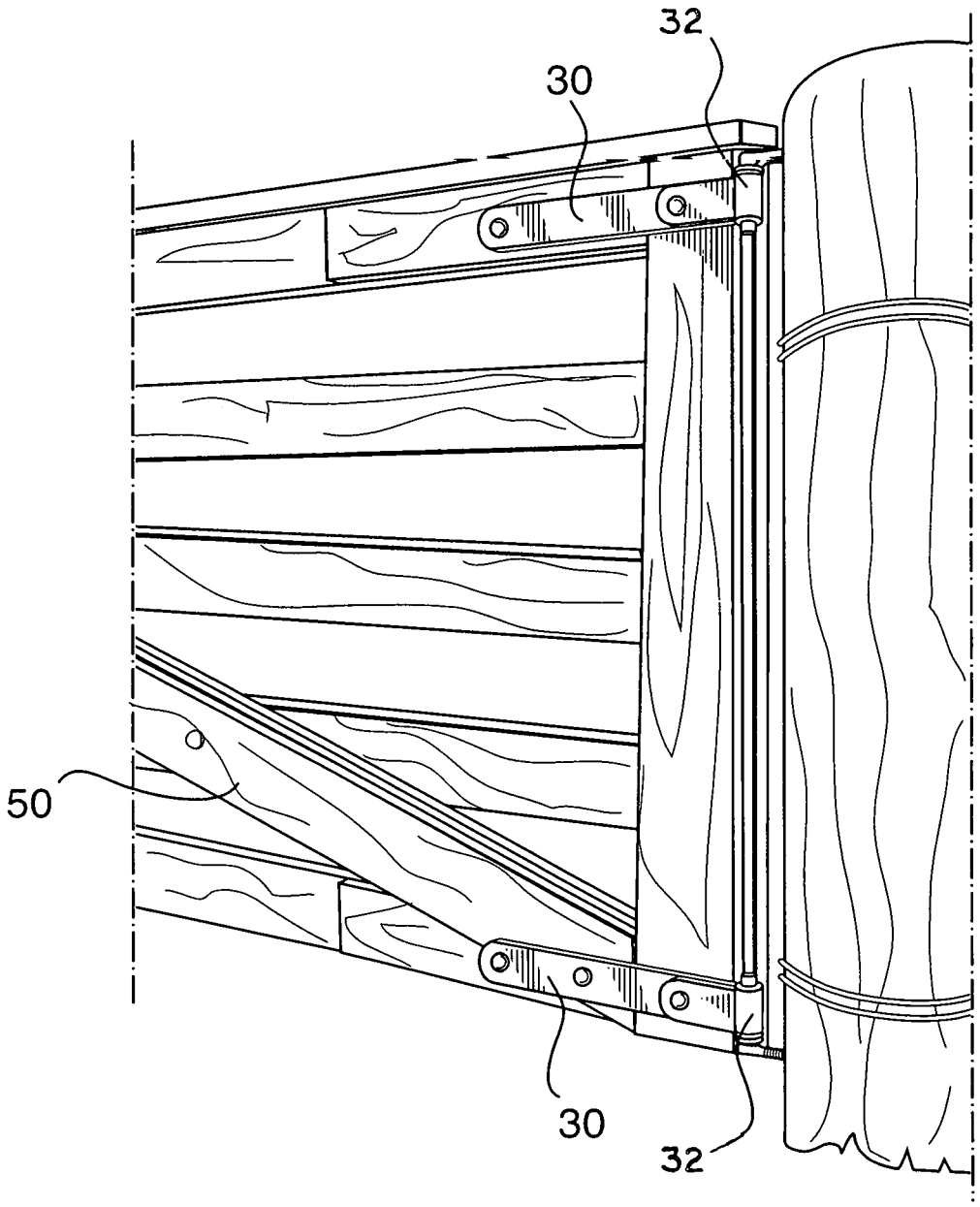
FIG. 6 is a front view of a gate with two two-part hinges.
Figure 7:
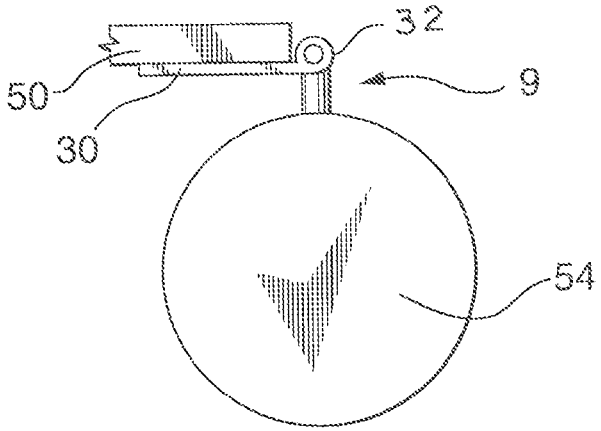
FIG. 7 is a top view of a post with a standard two part hinge.
Figure 8:
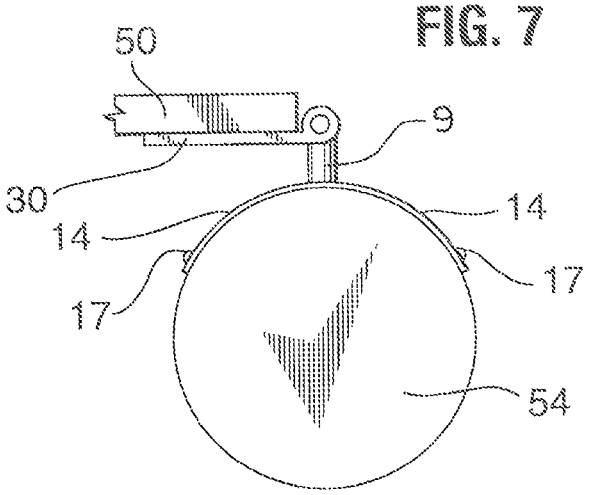
FIG. 8 is a top view of a post with a two part hinge of the present invention.
Figure 9:
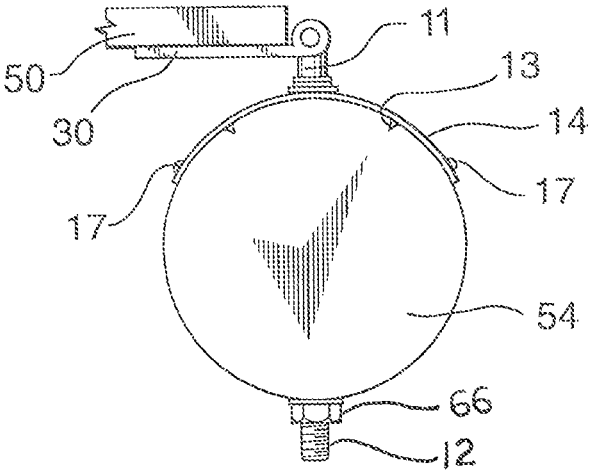
FIG. 9 is a top view of a post with a hinge pin having hinge support straps curved around a post showing a threaded nut affixed to the outer surface of the support strap by welding or rivets of other holding means cooperatively engaging the threaded shaft of the hinge pin and showing the threaded hinge pin extending through the post with a washer and threaded nut cooperatively engaging the threaded shaft of the distal end of the hinge pin for tightening the hinge pin against the post.
Figure 10:
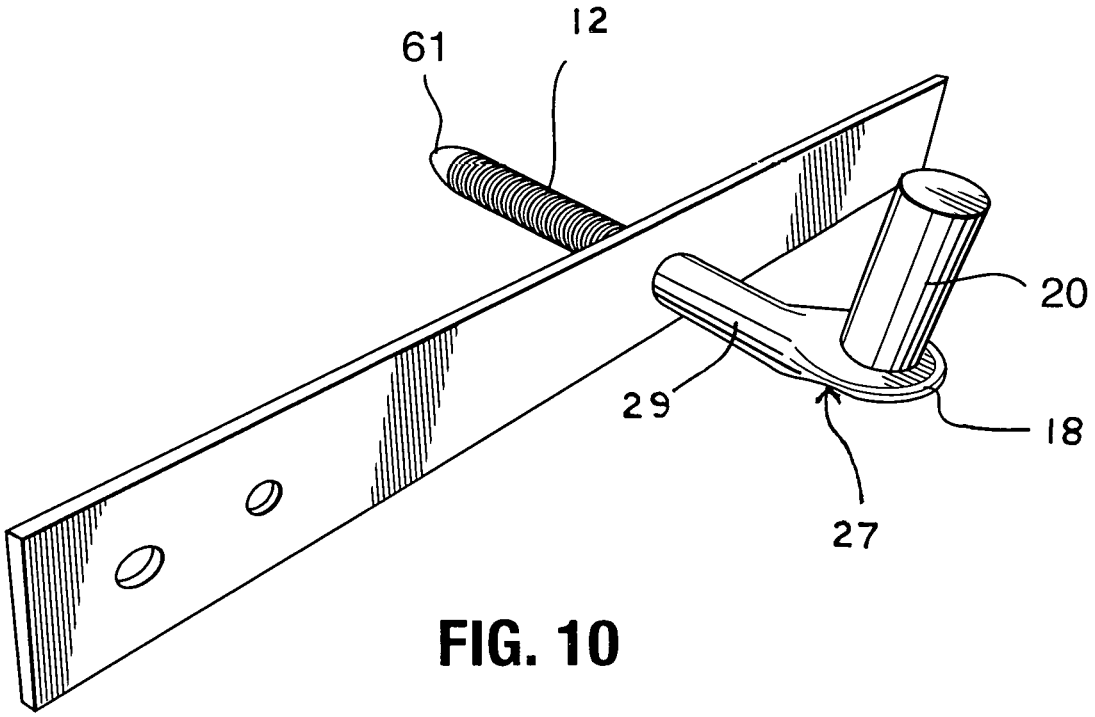
FIG. 10 is a perspective view of a picture showing the hinge pin post with formable support strap.
Figure 11:
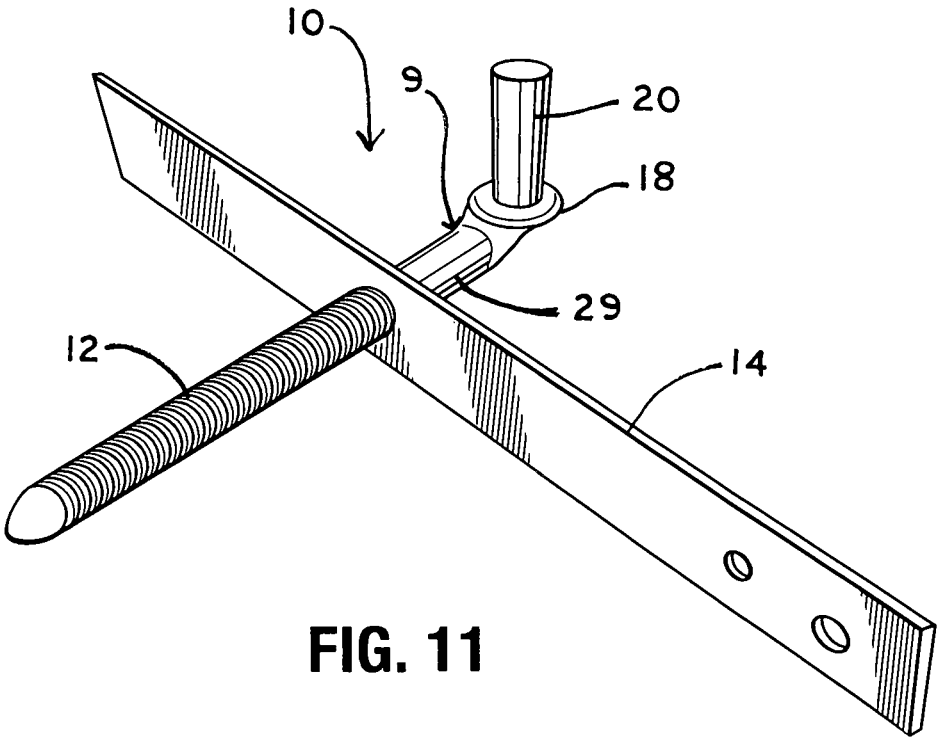
FIG. 11 is a perspective view of a picture showing the hinge pin threaded shaft with formable support strap.
Figure 12:
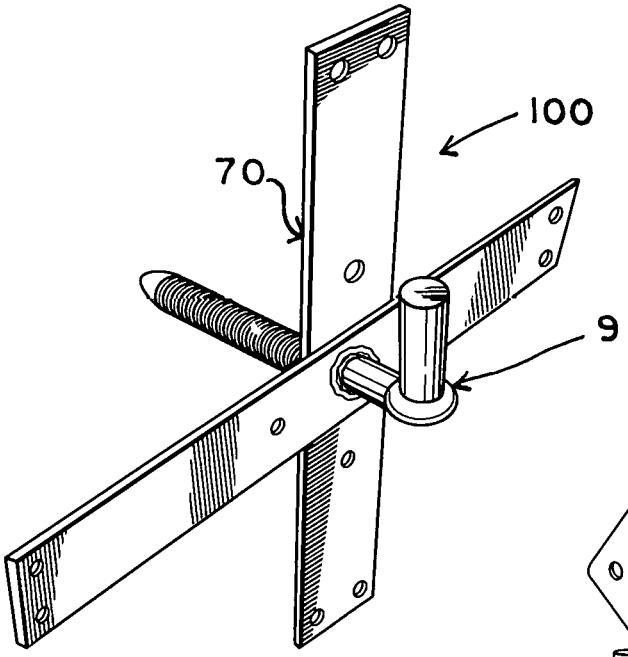
FIG. 12 is a perspective view showing a hinge pin and support strap wherein the support strap is comprised of two opposing diagonal straps forming an "X" support strap having a hole formed in the center thereof with the shaft of the hinge pin extending through a selected distance and the hinge pin is welded at the intersection of the neck to the threaded shaft to the edges of the hole formed in the center of the X support strap whereby the distal ends of the X support strap can be formed or bent around a post and nailed or screwed thereto after the threaded shank portion of the hinge pin has been screwed into the gate post.
Figure 13:
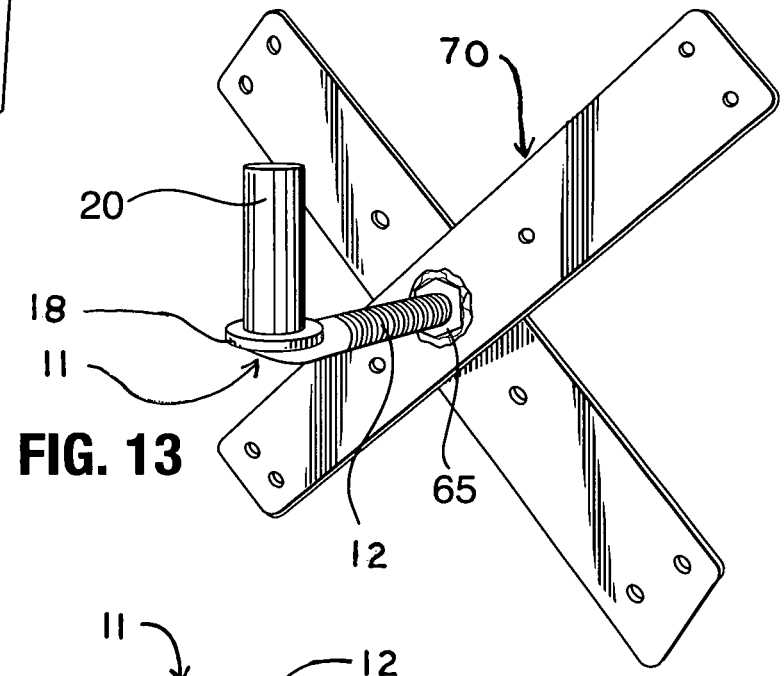
FIG. 13 is a perspective front view of FIG. 12 showing the "x" support strap wherein the threaded shaft of the hinge pin or "L-bolt" cooperatively engages a threaded nut affixed to the center thereof in alignment with a center thorough hole.
Figure 14:
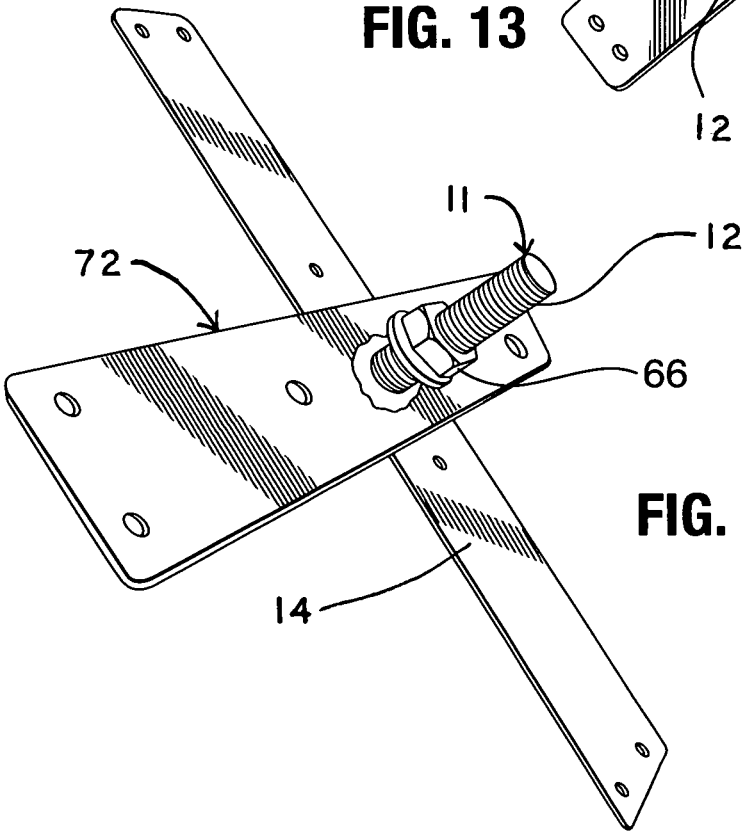
FIG. 14 is a perspective rear view of the embodiment of FIG. 13 showing the "x" support strap wherein the distal end of the threaded shaft of the hinge pin or "L-bolt" cooperatively engages a threaded nut for tightening the hinge pin against a post.
Figure 15:
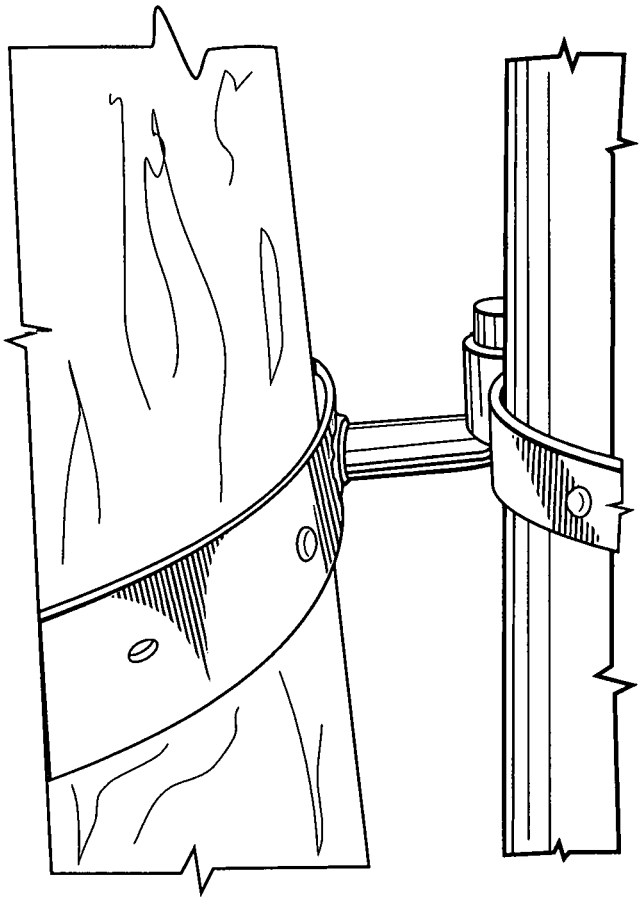
FIG. 15 is a perspective view showing the embodiment of FIGS. 9 and 10 affixed to a gate post whereby the support strap includes a hole formed in the center thereof with the shaft of the hinge pin extending through a selected distance and the hinge pin is welded at the intersection of the neck and threaded shaft to the edges of the hole formed in the center of the support strap whereby the distal ends of the support strap can be formed or bent around a post and nailed or screwed thereto after the threaded shank portion of the hinge pin has been screwed into the gate post supporting the pin receiving member of the gate.
Figure 16:
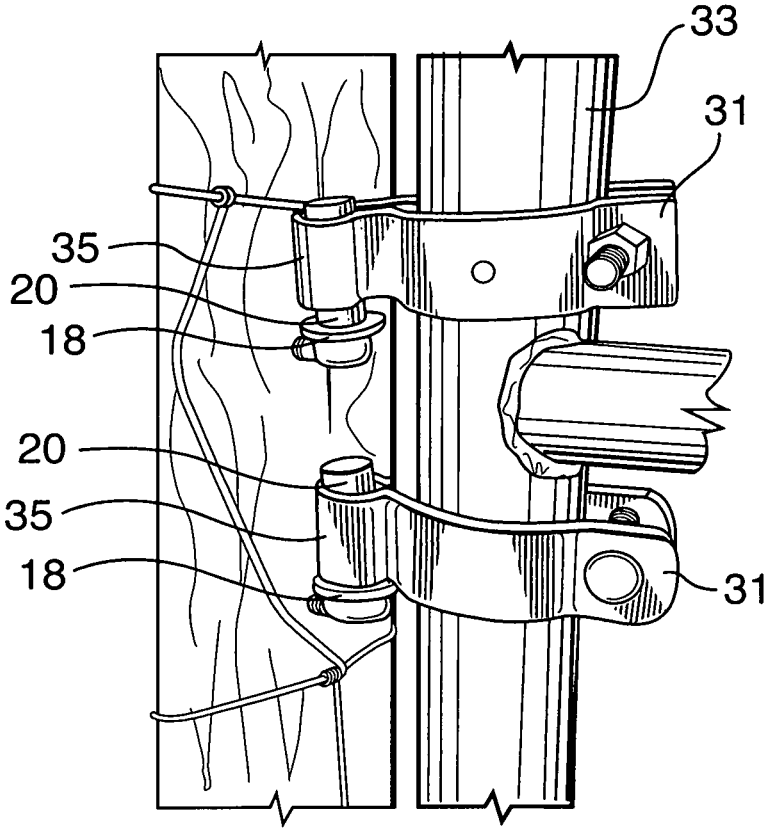
FIG. 16 PRIOR ART
FIG. 16 shows a gate mounted and supported by a conventional hinge pin whereby an additional hinge pin and pin receiving member have been added to the gate to provide sufficient support for the gate and showing the conventional lower gate hinge pin cocked at an angle due to insufficient lateral support with the post.

As shown in the FIGS. 4-7, a conventional gate hinge pin is shown supporting a gate with a gate hinge and pin assembly. The hinge and pin assembly includes a pair of spaced apart aligned loop strap members 30 affixed to a gate, each one shown as a long flat metallic rectangular member 34 with one end turned back on itself, forming a loop 32 extending past the edge of the gate for cooperative rotating engagement with the hinge pin 9. The loop strap member 30 includes a plurality of spaced apart attachment holes 36 drilled or formed therein for insertion of screws 17 or bolts for fastening the loop strap member to the vertical edge of a gate frame or support member as shown in FIGS. 4, 5, and 6, for cooperative engagement with a hinge pin extending from a post.

The L-shaped threaded hinge pin member 10 includes a threaded leg 12, a long rectangular metal strap 14 affixed on the threaded leg near the elbow 16 at right angles with the threaded leg, elbow which is 90 degrees, and a shorter upturned arm or stud 20 which is about two and one half inches long. The L-shaped member may comprise a integral formed member hinge pin 60 typically including a pointed tip 61 extending from a threaded longitudinal body 62 having a short upturned cylindrical shaft or stud 20 extending therefrom at a right angle usually with an enlarged collar 63 portion separating the arm and threaded longitudinal body, whereby the collar provides a support surface for rotational movement of a gate hinge thereon. The proximate end of the threaded section may be welded to the strap or to a stationary threaded nut 65 affixed to the strap by welding or other means.

The L-shaped member may also comprise an "L-bolt" having threaded longitudinal body with a short cylindrical arm or stud extending therefrom at a right angle including at least one and preferably two threaded nuts with optional washers for tightening the threaded member after insertion into a bore hole of a post. The threaded leg may be threaded from the pointed end 11 all the way to the elbow 16 but is preferably threaded only to about where the junction of the threaded leg is with the metal strap. The shorter leg 20 of the threaded hinge pin includes an optional flat metal washer or a collar 18 affixed near the elbow 16 and about two inches from the free end of the shorter leg 20. The top surface of the washer 18 is perpendicular to the shorter leg 20. Preferably, the proximate stationary nut may be permanently affixed to the outer surface of a strap preventing rotation of the nut and strap.

After insertion a selected depth through a bore hole in a post the threaded longitudinal member maybe tightened to the post by rotating the stud or a second threaded nut 66 and optional washer in cooperative engagement with the distal end of the threaded shaft 12 whereby the stationary strap nut is held while the second nut is rotated tightening the hinge pin against the post.

The longitudinal strap 14 is composed of a bendable metal or plastic material having memory allowing the strap to be bent and curved around a post. It is necessary that the metal strap is formable around the curved surface of a fence post. The pointed end 11 of the threaded leg passes through a hole in the center of the long metal strap 14 which is then permanently attached to the threaded leg about one and one half to two inches from the elbow 16. There is a selected number of smaller attachment holes and preferably at least four holes in the strap 14. It is contemplated that spikes 13 may also protrude from the inner surface of the straps for cooperative engagement with the posts in order that the spikes may be driven into the posts to prevent rotation of the straps on the post.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

I claim:

1. A gate hinge pin assembly consisting of:

a hinge pin consisting of a longitudinal body including a threaded shank having a distal point for threading into a bore drilled into a gate post, a cylindrical neck extending from a proximate end of said threaded shank, said cylindrical neck having a distal end extending at a 90 degree angle with respect to said threaded shank forming an elbow, said proximate portion of elbow consisting of a collar and a stud extending therefrom perpendicular from said threaded shank; and a bendable metal support strap consisting of a plurality of through holes formed therein, said bendable metal support strap is welded to said longitudinal body of said hinge pin at an intersection of said threaded shank and said cylindrical neck, said bendable metal support strap extends perpendicular to said longitudinal body, said bendable metal support strap including distal end portions that are bendable around a gate post conforming to a shape of said gate post, and said bendable metal support strap attaching to said gate post with means for holding preventing rotation of said bendable metal support strap and said hinge pin with respect to said gate post.

2. The gate hinge pin assembly of claim 1, wherein said means for holding is selected from the group consisting of nails, screws, bolts, and combinations thereof.

3. A gate hinge pin assembly consisting of:

a hinge pin having a longitudinal body consisting of a threaded shank having a distal point for threading into a bore drilled into a gate post, a cylindrical neck extending from a proximate end of said threaded shank, said cylindrical neck having a distal end extending at a 90 degree angle with respect to said threaded shank forming an elbow, said proximate portion of elbow having a collar and a stud extending therefrom perpendicular from said threaded shank;

a bendable metal support strap consisting of a plurality of throughholes formed therein, said bendable metal support strap is welded to said longitudinal body of said hinge pin at an intersection of said threaded shank and said cylindrical neck, said bendable metal support strap extending perpendicular to said longitudinal body, said bendable metal support strap with distal end portions that are bendable around a gate post conforming to a shape of said gate post, and said bendable metal support strap attaching to said gate post with means for holding preventing rotation of said bendable metal support strap and said hinge pin with respect to said gate post; and said bendable metal support strap consisting of a pair of crossing bendable metal support straps forming an x-shaped bendable metal support strap.

4. A gate hinge pin assembly consisting of:

a hinge pin having a longitudinal body including a threaded shank having a distal point for threading into a bore drilled into a gate post, a cylindrical neck extending from a proximate end of said threaded shank, said cylindrical neck having a distal end extending at a 90 degree angle with respect to said threaded shank forming an elbow, said proximate portion of elbow having a collar and a stud extending therefrom perpendicular from said threaded shank;

a bendable metal support strap consisting of a plurality of throughholes formed therein, said bendable metal support strap is welded to said longitudinal body of said hinge pin at an intersection of said threaded shank and said cylindrical neck, said bendable metal support strap extending perpendicular to said longitudinal body, said bendable metal support strap having distal end portions that are bendable around a gate post conforming to a shape of said gate post, and said bendable metal support strap attaching to said gate post with means for holding preventing rotation of said bendable metal support strap and said hinge pin with respect to said gate post; and said bendable metal support strap further having at least one spike protruding from an inner surface for cooperative engagement with said gate post.

5. The gate hinge pin assembly of claim 3, wherein said means for holding is selected from the group consisting of nails, screws, bolts, and combinations thereof.

6. The gate hinge pin assembly of claim 4, wherein said means for holding is selected from the group consisting of nails, screws, bolts, and combinations thereof.

* * * * *